United States Patent [19]

Pomerleau

[11] Patent Number: 4,759,143

[45] Date of Patent: Jul. 26, 1988

[54] ILLUMINATED SIGN ASSEMBLY

[76] Inventor: Maurice Pomerleau, 3240 Jefferson Blvd., Windsor, Ontario, Canada, N8T 2W8

[21] Appl. No.: 908,597

[22] Filed: Sep. 19, 1986

[51] Int. Cl.[4] ..... G09F 13/04

[52] U.S. Cl. ..... 40/574; 40/564

[58] Field of Search ..... 40/574, 572, 564, 549, 40/603

[56] References Cited

U.S. PATENT DOCUMENTS

| | | | |
|---|---|---|---|
| 3,848,349 | 11/1974 | Olsen | 40/574 |
| 3,863,372 | 2/1975 | Stilling | 40/574 |
| 4,169,327 | 10/1979 | Stilling | 40/549 |
| 4,267,657 | 5/1981 | Kloke | 40/549 |
| 4,452,000 | 6/1984 | Gandy | 40/574 |
| 4,542,605 | 9/1985 | Gandy | 40/574 |
| 4,547,987 | 10/1985 | Stilling | 40/574 |

FOREIGN PATENT DOCUMENTS

| | | | |
|---|---|---|---|
| 750111 | 1/1967 | Canada | 40/574 |

*Primary Examiner*—Gene Mancene
*Assistant Examiner*—Michael Lynch

[57] ABSTRACT

An illuminated sign assembly has a cabinet of somewhat resilient sheet material with a self-hinging sign frame on at least one side which snap fits into the cabinet without use of a conventional hinge. An assembly may be provided for security and tensioning the vinyl sheet of a sign face into the frame. The snap action is provided by interaction between a channel defined by a system of resilient flanges formed by a portion of the cabinet to which the frame is hinged, and an abutment on a rearwardly extending flange on a hinged side of the frame.

10 Claims, 5 Drawing Sheets

ILLUMINATED SIGN ASSEMBLY

FIELD OF THE INVENTION

The present invention relates to an illuminated sign assembly.

BACKGROUND OF THE INVENTION

The cabinet or casing for illuminated signs has traditionally been of box-like configuration formed by aluminum extrusions, and is generally arranged so that the assembly is weatherproof for outside use.

The cabinet has either one open face, for mounting a single-faced illuminated sign, or opposed open faces for mounting double-faced illuminated signs.

However, the use of aluminum extrusion for the cabinet has two disadvantages.

First, the aluminum is a rigid material, and if the sign frame is to be hingeable outwardly to open the cabinet for maintenance, some leeway must be provided where the sign frame hooks onto the top of the cabinet. Any such leeway will prevent a snug fit when the sign frame is closed against the cabinet, allowing the sign to rattle, with consequent potential damage, in heavy winds. Also, different widths of extrusion require separate extrusion moulds at a substantial cost per mould. Because of this cost, a relatively small variety of standard widths of aluminum extrusion are available for manufacturing illuminated sign cabinets. In addition, there is a physical limit on the width of aluminum extrusion which can be extruded of 12 to 14 inches. For illuminated sign assemblies with deeper cabinets, widths of extrusion must be fastened together, with consequent loss of weather-proofing.

SUMMARY OF THE INVENTION

The present invention is therefore directed to providing an illuminated sign assembly with a self-hinging sign frame which snap fits onto the cabinet and does not require a conventional hinge, and can also be assembled utilizing concealed fasteners to provide a clean and uninterrupted visual appearance meeting architectural standards.

The cabinet for the illuminated sign assembly in a first embodiment of the present invention is formed of a somewhat resilient sheet material, such as sheet metal. One advantage achieved by using sheet metal is that the cabinets for such sign assemblies can be formed of almost any width or profile, and of many different profiles to achieve various lighting and styling effects according to the user's requirements.

The invention is also directed to an improved assembly for securing and tensioning the vinyl sheet of a sign face onto a brace for inclusion in an illuminated sign assembly.

In one embodiment, an illuminated sign assembly is provided consisting of a cabinet for holding an illuminating device, formed of resilient sheet material and having side walls and an opening in one face. At least one side wall of the cabinet is provided with an inwardly directed flange adjacent the open face of the cabinet, a forwardly directed flange extending from the inwardly directed flange, and an outwardly directed flange extending from the forwardly directed flange and forming with the inwardly and forwardly directed flanges an outwardly opening channel. A return flange extending rearwardly from the outwardly directed flange is also provided. A sign frame is provided for mounting adjacent the open face. The sign frame has a rearwardly directed lip provided with a laterally extending abutment. The sign frame snaps from an inclined position, in which the lip extends inwardly into the channel, to a position parallel to the opening, in which the abutment and lip are compressed between the inwardly directed flange and the return flange.

Preferably, the return flange of the cabinet is offset inwardly from the at least one side wall. When the sign frame is in the position parallel to the opening, the sign frame has an outer wall which is then also parallel to the opening. The lip of the sign frame is preferably offset inwardly from this outer wall.

Means may also be provided for releaseably securing the sign frame to a wall of the cabinet opposite the at least one wall when the sign frame is in the position parallel to the opening.

In a separate embodiment of the invention, a vinyl retainer frame for an illuminated sign assembly is provided consisting of a rigid brace of substantially C-shaped configuration extending from one side of the frame to an opposite side, an internally serrated clip for receiving a longitudinal fold of one end of a vinyl sheet, a serrated retainer adapted to be received in the fold and the clip for snugly positioning the longitudinal fold of vinyl in the clip, and means for attaching and tensioning the clip at one end of the brace, while the sheet is secured at the opposite end of the brace. Preferably, a second clip and retainer are provided for attaching and tensioning a longitudinal fold of vinyl at the opposite end of the brace, in order to tension the vinyl sheet between the clips.

DETAILED DESCRIPTION OF PREFERRED EMBODIMENTS

Figure 1:
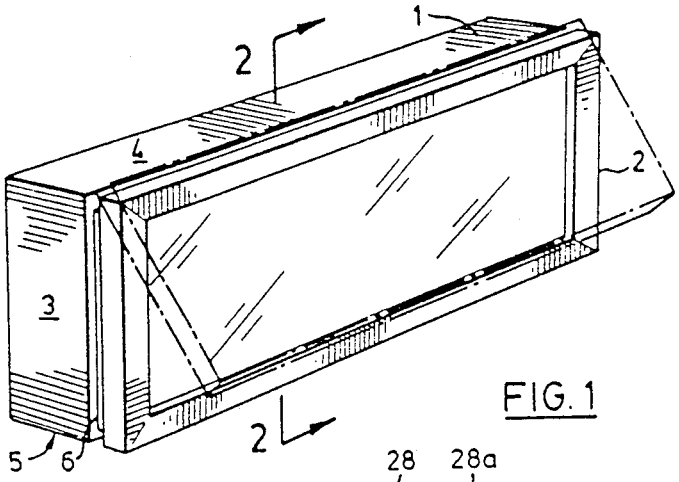
FIG. 1 is a perspective view of an illuminated sign assembly according to the invention showing the sign frame in closed position and, in phantom outline, showing the sign frame in hinged-open position.

In FIG. 1, an illuminated sign assembly is illustrated consisting of a cabinet 1 on which is mounted a sign frame 2.

The cabinet is provided with opposed side walls 3, top wall 4 and bottom wall 5. The front face is left open and the back may be either enclosed, for a single faced illuminated sign, or left open as well for a double faced illuminated sign.

Whilst preferably the cabinet is formed of bent sheet metal, or of some other suitable sheet material which is strong, sufficiently weatherproof and somewhat resilient, the use of other fabrication techniques such as extrusion or roll forming is not excluded.

Each wall of the cabinet terminates in a peripheral, outwardly opening channel 6 adjacent the open face of the cabinet 1.

If the cabinet is intended as a double-faced illuminated sign, a corresponding channel to channel 6 will also be formed adjacent an opposed open face.

Channel 6 is formed by inwardly directed flange 7, forming a resilient rear wall to the channel, forwardly directed flange 8 and outwardly directed flange 9. Although the cabinet is formed of resilient material, this arrangement of flanges serves to stiffen the structure of the cabinet while still allowing sufficient flexibility for the spring action which will be described below.

Outwardly directed flange 9 is bent inwardly to form shoulder 10 and inwardly directed flange 11, which may be hemmed, as shown at 11*a*, for rigidity and extra strength. Preferably lip 11 is offset inwardly from the cabinet wall 4.

Figure 3:
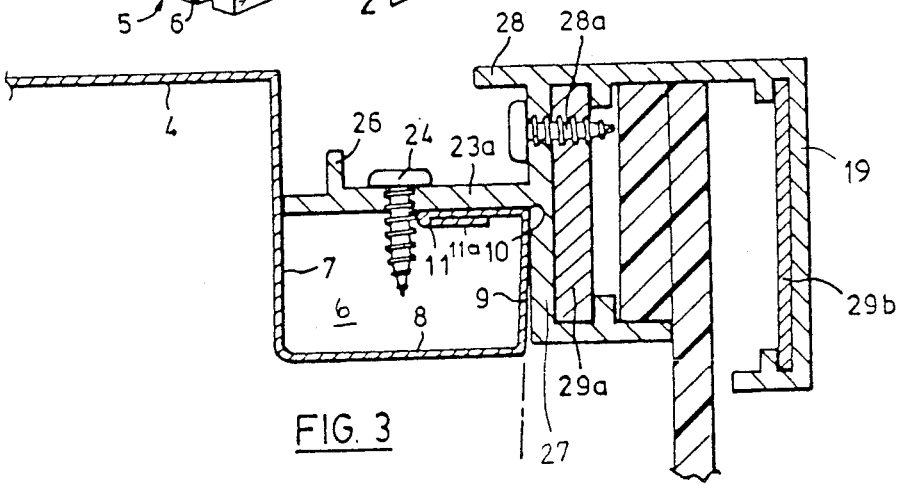
FIGS. 3 and 4, on the same page as FIG. 1, are fragmentary cross-sectional views of the snap-fit and hinge structure, showing the assembly in closed and open positions, respectively.
Figure 4:
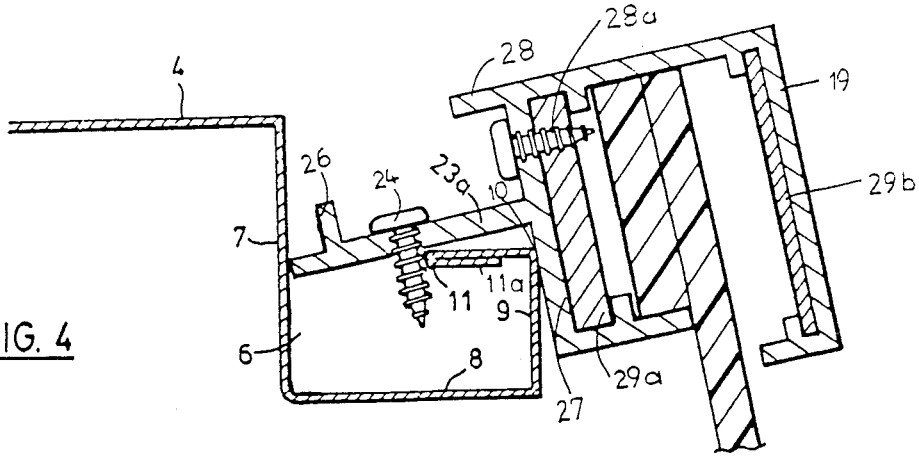
Figure 2:
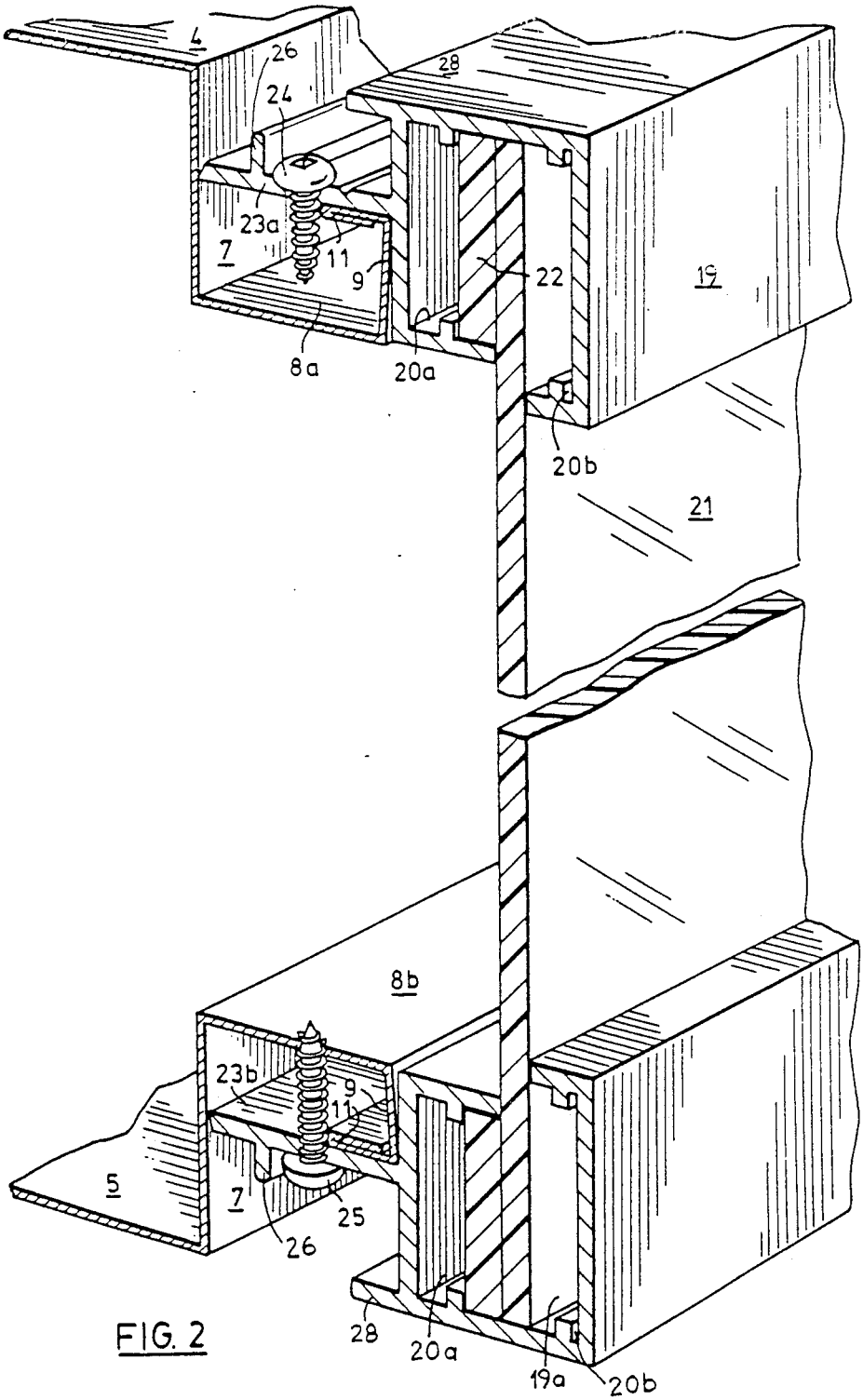
FIG. 2 is a cross-sectional view of a portion of the assembly of FIG. 1, taken along line 2—2, showing the assembly in closed position.

In one embodiment illustrated in FIGS. 2 to 4, the sign frame 2 is formed of aluminum extrusion lengths 19 of configuraton.

The sign face is formed of a rigid translucent plastic or acrylic sheet 21, which has a peripheral abutment 22, preferably formed of the same material as the sheet. Edges of the sheet 21 with abutment 22 may be inserted snugly along a channel 19*a* of a length of the aluminum extrusion 19, the abutment 21 acting to retain the sheet 21 in the extrusion channel 19*a*.

The ends of the lengths 19 may be mitred as seen in FIG. 1, and internal L-shaped corner brackets 29*a* and 29*b* (see FIG. 3) having opposite arms connected in channels 20*a* and 20*b* adjacent their ends, in conventional fashion, may serve to hold the lengths 19 together.

Each length of extrusion 19 is further formed with a rearwardly projecting right angle lip, generally designated by 23, which is preferably offset inwardly from the top of extrusion 19 to sit on lip 11.

Metal screws 24, which are substantially shorter than the depth of channel 6, may be inserted through top lip 23*a* to provide an abutment engaging the edge of flange 11 at the same time that the opposite edge of top lip 23*a* compressingly engages rear wall 7, for a spring or snap fit to positively locate the sign frame 2 on the cabinet. These screws may be self-tapping, or aperture may be pre-formed in the flange.

It will be obvious to one skilled in the art that the abutment may be constituted by posts or other similar structures formed with the lip 23*a*.

Once the sign frame 2 is closed in place on cabinet 2, longer metal screws 25 may be inserted through bottom lip 23*b*, to pass through wall 8*a*, to secure the sign frame 2 on the cabinet 1 (FIG. 2). Again, self-tapping screws may be utilised, or apertures pre-formed to accommodate the screws.

Flange 26 extending at a right angle from lip 23 acts to channel water off the edges of the sign frame when the sign assembly is closed. Flange 26 also provides an aesthetically neater appearance to the sign assembly construction.

The outer surface of the extrusion 19 is extended rearwardly to form a flange 28 outward of the lip 23 which serves to hide fasteners such as screws 28*a* utilized to secure the brackets 29*a*.

The flange 28 gives the sign assembly construction a finished appearance, to provide a clean architectural appearance. Flange 28 also functions to channel water, thereby improving the weatherability of the assembly.

As illustrated in FIG. 4, the sign frame may be hinged outwardly to allow maintenance on the illuminating device inside the cabinet 1. When the sign frame 2 is tilted outwardly from the open face of cabinet 1, the end of top lip 23*a* will engage flange 7 in order to provide support to the forward portion of lip 23*a* hinging on flange 11 and the rear wall 27 of extrusion 19 hinging on shoulder 10. The abutment or screw 24 simultaneously engages the end of lip 11, and suspended support of the sign frame 2 in the hinged open position is achieved by compression of the screw 24 against the end of flange 11 and the end of flange 23*a* against the somewhat resilient surface of flange 7.

In this manner, sign frame 2 may be hinged on cabinet 1 without the necessity for any additional props or stops.

Figure 5:
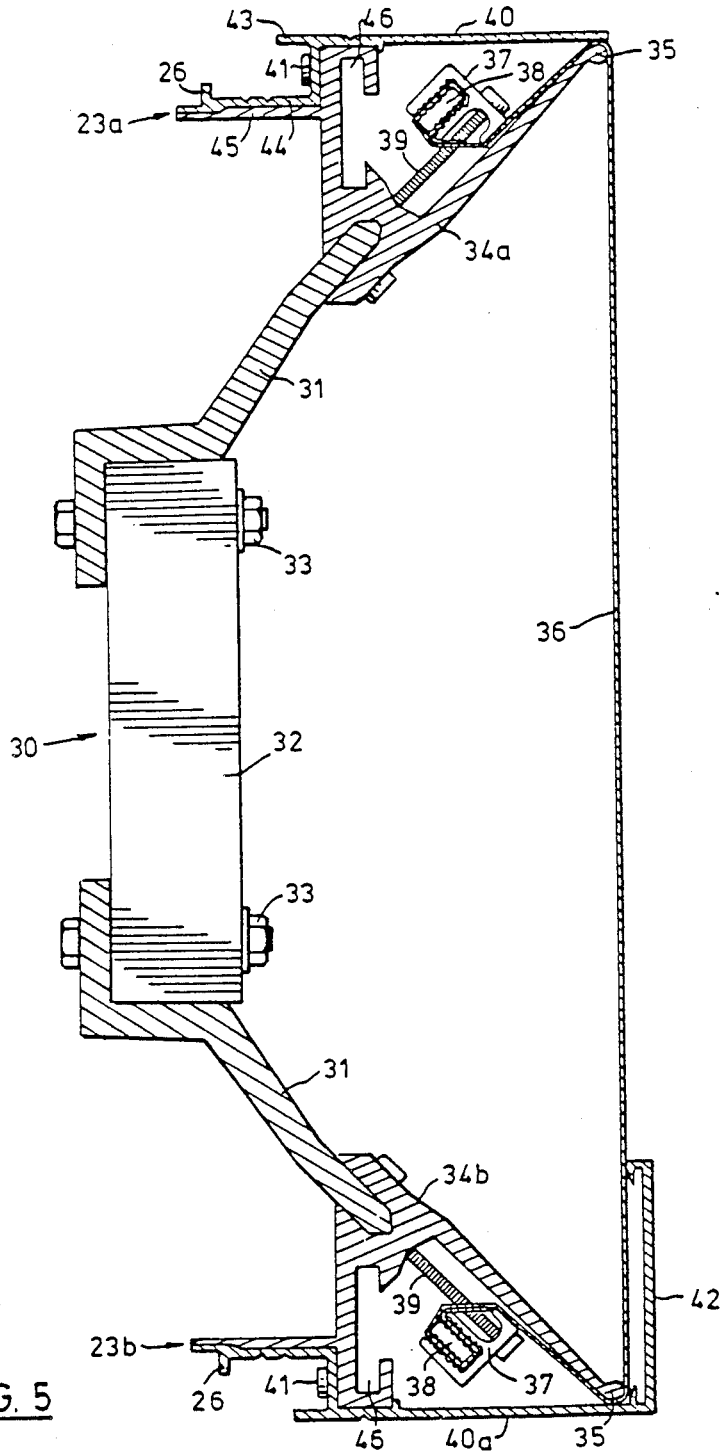
FIG. 5 is a cross-sectional view of the vinyl-retaining assembly, according to the invention.

In FIG. 5, a second embodiment for the sign frame 2 is illustrated. In this case, the sign itself is formed of a flexible material such as vinyl.

The main component of the sign frame is generally a C-shaped brace 30 which is formed of two brace brackets 31 connected to intermediate rigid column 32 by bolts 33. The brace brackets 31 are thus usable to connect to an intermediate column 32 of any length, and the sign can thus be easily modified by size.

Braces 30 may be placed at approximately four to five feet intervals along the length of a sign to provide adequate support for the structure.

Each brace bracket 31 is inserted into a frame 34 provided with blunt end 35 over which vinyl 36 passes. Frame 34 is a continuous frame, assembled at mitered corners, to provide a four-sided structure. L-shaped corner brackets may be inserted into channel 46*a* to secure the corners of frame 34.

Along the top and bottom edges, a longitudinal fold is formed in the vinyl 36, and each fold inserted into a clip 37 provided with internal serrations. Each clip 37 is approximately three inches in length, and it has been found most advantageous to place a clip 37 approximately every ten inches around the perimeter of frame 34.

A serrated retainer 38, of the same length as the clip 37, is forced, in the middle of the fold, into the mouth of clip 37 to snugly secure the fold of vinyl in the clip 37.

The two clips 37 are affixed to opposed frames 34*a* and 34*b* with the vinyl sheet 36 at first slack between them. Long bolts or screws 39, which are used to attach the clips 37 to the frame 34, may be adjusted to tension or loosen the vinyl sheet 36 held between them. As tension is applied to the sheet 36, it pulls the serrated retainer 38 and the folded edge portion of the vinyl against the clip thus providing a secure fastening.

Cover 40 is a continuous length of extrusion attached over the frame 34 around its perimeter by bolts 41, in order to protect the internal sign assembly from the weather.

Alternatively, cover 40*a*, having a right-angle flange 42 framing all or a portion of the perimeter of the face of the sign, may be substituted.

Figure 6:
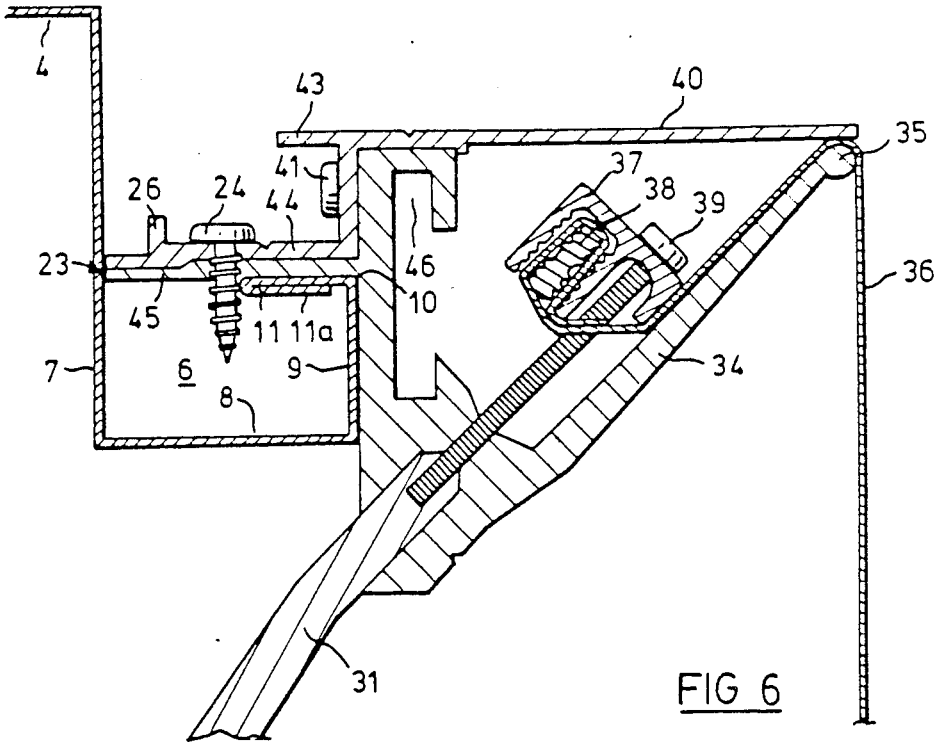
FIGS. 6 and 7 are fragmentary cross-sectional views showing the vinyl retaining assembly mounted on a cabinet in closed and open positions, respectively.
Figure 7:
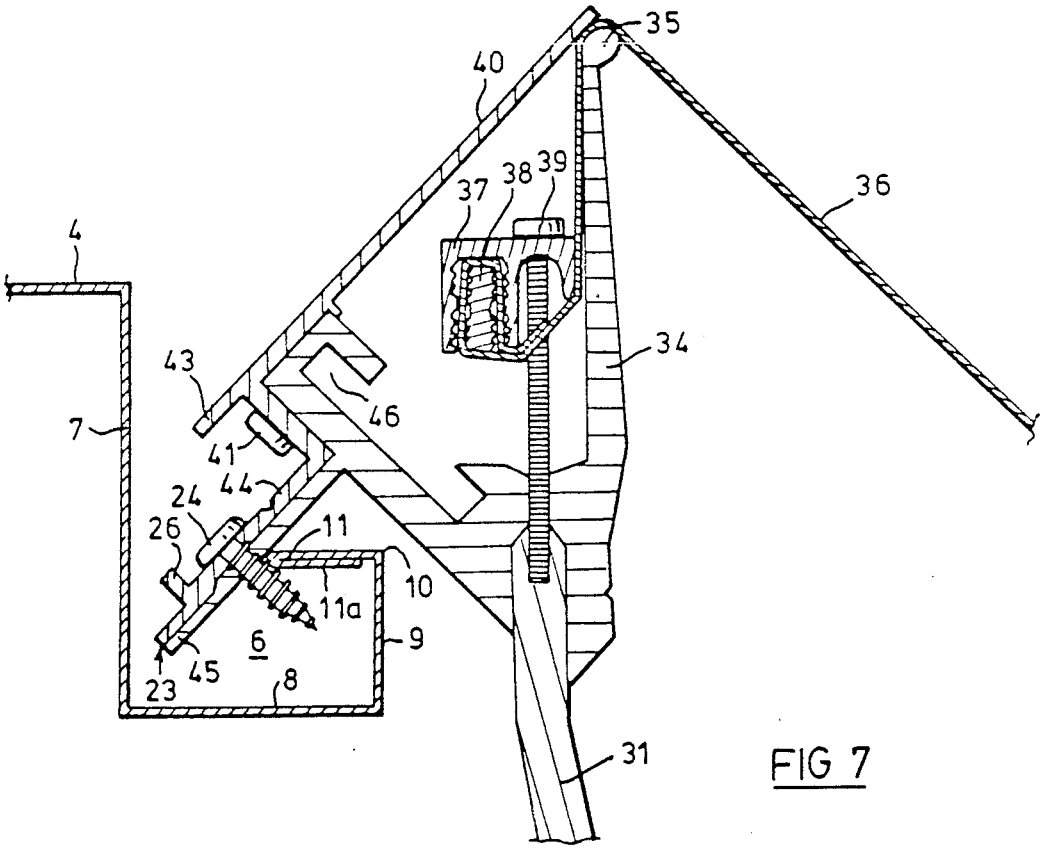

As illustrated in FIGS. 6 and 7, it is intended that the vinyl sign frame be mountable and self-hingeable on the cabinet 1 in the same manner as previously described.

An overhang 43 may also be provided, extending rearwardly from cover 40, providing aesthetic finish and water channelling as described above in relation to overhand 26 illustrated in FIGS. 2 to 4.

In this embodiment, it is pointed out that lip 23 is actually a composite structure constructed of flange 44 rearwardly projecting from cover 40 overlying flange 45 rearwardly projecting from frame 34. The two flanges 44 and 45 are held together both by bolt 41 connecting cover 40 and frame 34 and also by metal screw 24, which also acts as the abutment against flange 11 in the hinging action of the sign frame 2.

Flange 44 is provided with water-channelling flange 26 extending outwardly at a right angle.

Figure 8:
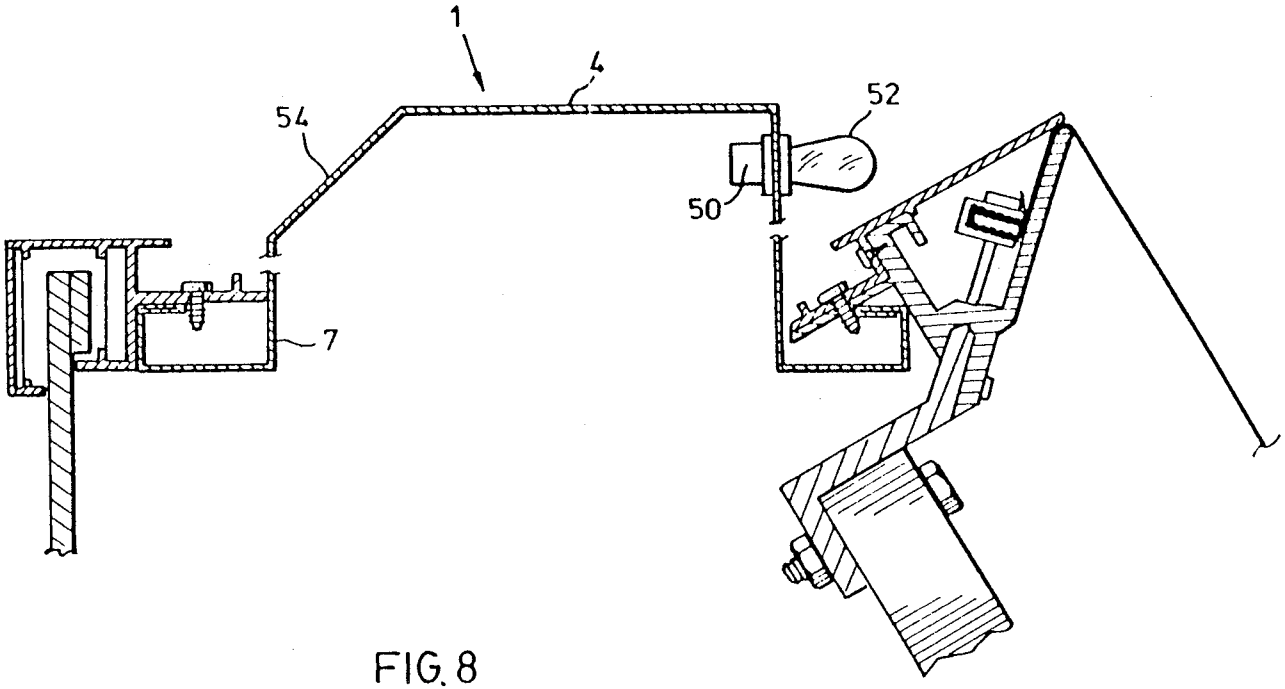
FIG. 8 is a fragmentary cross-section through the upper portion of an alternative embodiment of sign assembly, illustrating alternative cabinet configurations.

FIG. 8 illustrates an example of how the configuration of the outside walls of the cabinet 1 may be altered to suit customer requirements. In the example shown, the depth of the flanges 7 is increased so as to move the wall 4 outwardly. The housing so formed can provide a raceway for the mounting of receptacles 50 for lumps 52, and may be profiled, as by a bevel 54, to provide a desired appearance.

I claim:

1. An illuminated sign assembly, comprising:

a cabinet for holding an illuminating device, formed of resilient sheet material and having side walls and an opening in one face, at least one side wall having an inwardly directed flange adjacent the open face, a forwardly directed flange extending from the inwardly directed flange, an outwardly directed flange extending from the forwardly directed flange and forming with the inwardly and forwardly directed flanges an outwardly opening channel, and a return flange extending rearwardly from the outwardly directed flange; and a sign frame mounted adjacent the open face and having a rearwardly directed lip provided with a laterally extending abutment, and which snaps from an inclined position wherein the lip extends inwardly into said channel to a position parallel to said opening wherein the abutment and the lip are compressed between the inwardly directed flange and said return flange.

2. An illuminated sign assembly, according to claim 1, wherein the return flange is offset inwardly from said at least one side wall.

3. An illuminated sign assembly, according to claim 2, wherein the sign frame further comprises an outer wall parallel with said at least one side wall when the sign frame is in the position parallel to said opening, and wherein the lip is offset inwardly from said outer wall.

4. An illuminated sign assembly, according to claim 3, wherein the lip of the sign frame is provided with an outwardly projecting right angle flange, which right angle flange forms a channel with a portion of the lip and a portion of the outer wall for diverting water when the sign frame is in the position parallel to said opening.

5. An illuminated sign assembly, according to claim 1, wherein the cabinet is provided, at a wall opposite said at least one wall, with means for releasably securing the sign frame to said opposite wall of the cabinet when the sign frame is in the position parallel to said opening.

6. An illuminated sign assembly, according to claim 5, wherein the cabinet is provided with said inwardly directed, forwardly directed, outwardly directed and return flanges on all of said side walls, and wherein the sign frame is provided with rearwardly directed lips corresponding to each of said side walls.

7. An illuminated sign assembly, according to claim 6, wherein the abutment means comprise a screw inserted through the lip of the sign frame.

8. An illuminated sign assembly, according to claim 7, wherein the means for releasably securing the sign frame to the opposite wall of the cabinet comprise a screw insertable through the lip and the forwardly projecting flange of said opposite wall.

9. An illuminated sign assembly, according to claim 1, wherein said at least one wall is a top wall of the cabinet.

10. An illuminated sign assembly, according to claim 1, wherein the sign frame is formed of rigid extrusion.

* * * * *